US005544810A

United States Patent [19]

Horvath, Jr. et al.

[11] Patent Number: 5,544,810

[45] Date of Patent: Aug. 13, 1996

[54] PRECISION-RATIOED FLUID-MIXING DEVICE AND SYSTEM

[75] Inventors: Stephen R. Horvath, Jr.; Robert D. Abrams, both of Racine; Thomas A. Helf, New Berlin, all of Wis.

[73] Assignee: S. C. Johnson & Son, Inc., Racine, Wis.

[21] Appl. No.: 159,909

[22] Filed: Nov. 30, 1993

Related U.S. Application Data

[63] Continuation of Ser. No. 808,939, Dec. 13, 1991, abandoned, which is a continuation of Ser. No. 513,401, Apr. 23, 1990, abandoned.

[51] Int. Cl.[6] ..... B05B 7/28

[52] U.S. Cl. ..... 239/10; 239/310; 239/304

[58] Field of Search ..... 285/92, 319, 305; 239/10; 248/79, 405; 222/384, 464; 234/303, 304, 307, 310, 318, 427, 427.3, 59

[56] References Cited

U.S. PATENT DOCUMENTS

| | | | |
|---|---|---|---|
| 1,382,684 | 6/1921 | Shimper . | |
| 2,039,275 | 4/1936 | McGrael | 299/84 |
| 2,228,705 | 1/1941 | Olson . | |
| 2,295,661 | 9/1942 | Hunter | 239/318 X |
| 2,389,413 | 11/1945 | Carlton | 137/2 |
| 2,536,361 | 1/1951 | Flanders | 299/84 |
| 2,543,294 | 2/1951 | McCabe | 239/318 |
| 2,571,871 | 10/1951 | Hayes | 239/318 X |
| 2,719,704 | 10/1955 | Anderson et al. | 261/18 |
| 2,736,466 | 2/1956 | Rodth . | |
| 2,761,734 | 9/1956 | Farmer | 299/84 |
| 2,788,244 | 4/1957 | Gilmour | 239/318 X |
| 2,796,196 | 5/1957 | Ortner . | |
| 2,811,389 | 10/1957 | Fischer | 299/84 |
| 2,991,939 | 7/1961 | Packard | 239/114 |
| 3,062,229 | 11/1962 | Riggs | 239/318 X |

(List continued on next page.)

OTHER PUBLICATIONS

"Dema push–button Blend Center" Brochure, Dema Engineering Co., St. Louis, MO, Bulletin No. 87003, 2 pages.

"Sani–Center Installation and Operation Manual", Ecolab Institutional Divison, St. Paul, MN, No. 9229–2150, 1989, 11 pages.

"Dema Model 162 Drum–Mount Proportioner" Brochure, Dema Engineering Co., St. Louis, Mo, Bulletin 84002, 1 page.

"Demamatic Liquid Level Proportioning Controls" Brochure, Dema Engineering Co., St. Louis, Mo, Bullentin 87–012, 2 pages.

(List continued on next page.)

*Primary Examiner*—Kevin Weldon

*Attorney, Agent, or Firm*—R. E. Rakoczy; J. W. Frank

[57] ABSTRACT

A fluid-mixing device and a fluid-dispensing system are disclosed. The fluid-mixing device comprises a nozzle (200) having an outlet (210), an inlet (208) adapted for receiving a high-pressure liquid diluent, a nozzle mixing chamber (226), an orificed fluid passageway (236) communicating with the mixing chamber (226), and an orificed fluid-metering element (180) in fluid communication with the fluid passageway (236). A vacuum effect is created in the mixing chamber (226) when high-pressure liquid is passed from the nozzle inlet (208) to the nozzle outlet (210). The fluid-dispensing system comprises a container (144) having a spout (146) and adapted for containing a dilutable liquid concentrate, an apertured plug (152) snap-engaged into the spout (146) and in fluid communication with the nozzle mixing chamber (226), and conduit (192) for passing liquid concentrate from the container (144) into the mixing chamber (226) via the orificed fluid passageway (236) and orificed fluid-metering element (180), the vacuum effect thus causing the liquid concentrate and the high-pressure liquid diluent to combine in the mixing chamber (226) to produce a liquid mixture, the orificed fluid passageway (236) and the orificed fluid-metering element (180) both being dimensioned for selecting precisely-ratioed amounts of concentrate-to-diluent in the liquid mixture.

21 Claims, 9 Drawing Sheets

U.S. PATENT DOCUMENTS

| | | | |
|---|---|---|---|
| 3,090,529 | 5/1963 | Lipman . | |
| 3,104,823 | 9/1963 | Hayes | 239/304 |
| 3,181,797 | 5/1965 | Hayes | 239/427.3 X |
| 3,231,200 | 1/1966 | Heald | 239/318 |
| 3,333,601 | 8/1967 | Lofgreen | 137/604 |
| 3,459,334 | 8/1969 | Evans | 222/132 |
| 3,608,829 | 9/1971 | Forsman | 239/318 |
| 3,822,217 | 7/1974 | Rogers | 252/359 E |
| 3,857,409 | 12/1974 | Aubrey et al. | 137/604 |
| 3,917,172 | 11/1975 | O'Hare | 239/305 |
| 3,955,572 | 5/1976 | Martin . | |
| 3,964,689 | 6/1976 | Horvath, Jr. . | |
| 3,995,572 | 12/1976 | Saunders . | |
| 4,027,822 | 6/1977 | Usher | 239/305 |
| 4,029,260 | 6/1977 | Herrick | 239/282 |
| 4,058,296 | 11/1977 | Wetherby | 366/160 |
| 4,068,681 | 1/1978 | McNair et al. | 137/588 |
| 4,079,861 | 3/1978 | Brown . | |
| 4,135,646 | 1/1979 | Shaw | 222/144 |
| 4,197,872 | 4/1980 | Parker | 137/115 |
| 4,218,013 | 8/1980 | Davison | 239/74 |
| 4,382,552 | 5/1983 | Lubsen et al. | 239/318 X |
| 4,406,406 | 9/1983 | Knapp . | |
| 4,491,254 | 1/1985 | Viets et al. | 222/83.5 |
| 4,506,815 | 3/1985 | Melas et al. | 222/630 |
| 4,508,272 | 4/1985 | Thompson | 239/318 |
| 4,527,740 | 7/1985 | Gunzel et al. | 239/318 |
| 4,545,535 | 10/1985 | Knapp . | |
| 4,722,363 | 2/1988 | Allyn | 137/599.1 |
| 4,790,454 | 12/1988 | Clark et al. . | |
| 4,804,465 | 2/1989 | Brown | 210/136 |
| 4,834,423 | 5/1989 | Deland | 285/319 X |
| 4,840,311 | 6/1989 | Shamblin | 239/74 |
| 4,846,206 | 7/1989 | Peterson | 137/1 |
| 4,901,923 | 2/1990 | McRoskey et al. | 239/123 |
| 4,930,686 | 6/1990 | Ellison | 222/394 |
| 5,033,649 | 7/1991 | Copeland et al. | 222/132 |
| 5,042523 | 8/1991 | Robertson et al. | 137/271 |
| 5,050,340 | 9/1991 | Seifert | 47/48.5 |
| 5,054,231 | 10/1991 | Witherspoon | 43/124 |
| 5,071,070 | 12/1991 | Hardy | 239/311 |
| 5,135,173 | 8/1992 | Cho | 239/305 |
| 5,159,958 | 11/1992 | Sand | 137/888 |
| 5,215,216 | 6/1993 | Van Marcke | 222/1 |
| 5,228,598 | 7/1993 | Bally et al. | 222/129.2 |
| 5,255,820 | 10/1993 | Thomas | 222/1 |

OTHER PUBLICATIONS

"Control Tower II Specialty Product Dispenser" Brochure, Economics Laboratory, Inc., St. Paul, MN, No. 13554/0402/07883, 2 pages.

"Multi–Blend Center" Brochure, Dema Engineering Co., St. Louis, MO, Bulletin 89010, 2 pages.

"Demamatic Liquid Level Proportioning Controls" Brochure, Dema Engineering Co., St. Louis, MO, Bulletin 83009, 2 pages.

"HydroSprayer Series Liquid Proportioners" Brochure,Hydro System Co., Cincinnati, OH, Bulletin 969500, 1989, 2 pages.

"New Product Development: Mulitiple Product Selector Valve" Brochure, Hydro System Co., Cincinnati, OH, 1 page.

"New Product Development: Variable Dilution Selector Valve" Brochure, Hydro Systems Co., Cincinnati, OH, 1 page.

"HydroFoamer Series Automatic Foaming Hose End Liquid Proportioner," Brochure, Hydro Systems Co., Cincinnati, OH, Bulletin 969445, 1988, 2 pages.

"Product and Equipment Profiles" Catalog, Ecolab Institutional Products Divison, St. Paul, MN, Brochure No. 5433/0415/0587, 1987 pp. 11–12.

"Dema Catalog 22 Liquid Chemical Injectors," Dema Engineering Co., St. Louis, MO, 8 pages.

"Dema Series 'C' Injectors" Brochure, Dema Engineering Co., St. Louis, MO, Bulletin 83011 2 pages.

"Dema Series 'B' Adjustable Injectors" Brochure, Dema Engineering Co., St. Louis, MO, Bulletin 83010, 2 pages.

"Dema Automatic Feeding and Proportioning Devices Catalog 84, " Dema Engineering Co., St. Louis, MO, 16 pages.

"Replacement Parts Diagrams–Express Feeders," Ecomonics Laboratory, Inc., St. Paul, MN, pp. 1–3 (Nos. 2131/0410/0185; 2131/0403/0782).

"Replacement Parts Diagrams–Sanijector," Ecomomics Laboratory, Inc., St. Paul, MN, p. 5 (Nos. 2131/0408/0185).

"Replacement Parts Diagrams–AS–1 Feeder," Ecomonics Laboratory, Inc. St. Paul MN, p. 5 (No. 2131/0411/1086).

"Replacement Parts Diagrams–Control Tower Model II, " Economics Laboratory, Inc., St. Paul, MN, p. 19, (No. 2131/0402/1086).

"Replacement Parts Diagrams –Control Tower Model SPD–2 & SPD–4," Economics Laboratory, Inc., St. Paul, MN. pp.20–21 (Nos. 2131/0404/0484 and 2131/0404/0484).

"Replacement Parts Diagrams–MIKRO–SPRAY J–6," Ecomonics Laboratory, Inc., St. Paul, MN, p. 10,(No. 2131/0400/1086).

PRECISION-RATIOED FLUID-MIXING DEVICE AND SYSTEM

This is a continuation of application(s) Ser. No. 07/808,939 filed on Dec. 13, 1991, now abandoned which is a continuation of Ser. No. 07/513,401, filed on Apr. 23, 1990, now abandoned.

TECHNICAL FIELD

Our present invention, in general, is directed both to a device as well as to a system for mixing certain fluids in predetermined precisely-ratioed amounts, for the purpose of producing a wide variety of fluid mixtures of predetermined compositional make-up.

BACKGROUND ART

Nozzles, known to produce a vacuum condition via a venturi effect, have long been used to combine certain liquids for purposes of producing various liquid mixtures. See, for example, U.S. Pat. No. 1,382,684 to Shimper as well as U.S. Pat. No. 2,228,705 to Olson.

When it is desirable to combine liquids in predetermined ratioed amounts, on the other hand, nozzles are generally not the liquid-mixing devices of choice, because variations in vacuum can affect individual flowrates of such liquids into the nozzle. As a result, other types of liquid-mixing devices have in the past been used for purposes of combining liquids in predetermined ratioed amounts. See, for example, U.S. Pat. No. 2,736,466 to Rodth; U.S. Pat. No. 2,796,196 to Ortner; and U.S. Pat. No. 4,079,861 to Brown. Unfortunately, liquid-mixing devices of these sorts are generally inherently more complex than nozzles, both in design and in operation.

From a manufacturing standpoint as well as from a "use" standpoint, simplicity in design and operation are generally desirable because of the various cost efficiencies which are attendant thereto. Indeed, certain recent advances in the nozzle art are disclosed and discussed in U.S. Pat. Nos. 4,406,406 and 4,545,535, both to Knapp.

In general, the '406 and '535 Knapp patents each disclose a liquid-metering apparatus as well as a liquid-dispensing apparatus for spraying plants with so-called "micro-dispensing amounts" of certain desired liquids. In particular, the '406 and '535 Knapp patents each disclose a liquid-metering apparatus as well as a liquid-dispensing apparatus for combining between 200 parts to 4,000 parts of liquid concentrate with a million parts of water.

As a practical matter, considering only the concentrate, a range of 200 "parts" to 4000 "parts" is, in certain situations, overly narrow. Indeed, there are a number of applications where it would be desirable to operate in a relatively broader range, considering only the concentrate.

For example, there are a number of applications where it would be desirable to mix a liquid concentrate with a liquid diluent, within the concentrate-to-diluent ratio range of about 1:2 to about 1:1500.

Because of the above-mentioned design simplicity and attendant cost efficiencies, it would be highly desirable to utilize the venturi effect of a nozzle to combine fluids in precisely-ratioed amounts to produce various fluid mixtures.

Those skilled in the nozzle art well know, however, that nozzles which are designed in accordance with the principles of current technology are not able to reproducibly provide a desired liquid mixture, principally due to flow and/or pressure fluctuation of the so-called "prime mover" fluid through the nozzle.

Thus it would be even more desirable, after selecting a particular concentrate-to-diluent ratio, to be able to utilize nozzles to achieve a particular, desired concentrate-to-diluent ratio, for purposes of mixing fluids in predetermined precisely-ratioed amounts, with no more than about 10 percent volume variation occurring in the concentrate-to-diluent ratio that was selected initially.

SUMMARY DISCLOSURE OF INVENTION

Briefly stated, one aspect of our invention is directed to a fluid-mixing device. Another aspect of our invention is directed to a fluid-dispensing system. A still further aspect of our invention is directed to a fluid-mixing system.

The fluid-mixing device comprises a nozzle. The nozzle defines a nozzle inlet adapted for receiving a high-pressure liquid diluent. The nozzle further defines a nozzle mixing chamber and a nozzle outlet. The nozzle mixing chamber defines a vacuum region when high-pressure liquid diluent enters the nozzle inlet and discharges from the nozzle outlet. The nozzle further defines a liquid-metering passageway having an orificed outlet which is in fluid communication with the nozzle mixing chamber. The liquid-metering passageway includes an inlet port that communicates with the vacuum region via the orificed outlet. The fluid-mixing device further comprises a liquid-metering element having an outlet port which is in fluid communication with the inlet port of the liquid-metering passageway. The liquid-metering element includes an orificed inlet that communicates with the vacuum region via the orificed outlet of the liquid-metering passageway. The fluid-mixing device still further comprises a conduit for conveying liquid concentrate through the liquid-metering element and thereafter into the inlet port of the liquid-metering passageway, for combining liquid diluent and liquid concentrate in predetermined ratioed amounts in the nozzle mixing chamber.

The fluid-dispensing system comprises a container having an opening and adapted to contain a liquid concentrate. The fluid-dispensing system further comprises a nippled plug disposed into the container opening and removably snap-engaged therewith. The plug nipple defines a plug aperture. The fluid-dispensing system includes conduit. One end of such conduit is removably carried via the plug nipple. The other end of the conduit is removably disposed through the container opening and is adapted to be immersed into a liquid concentrate that is contained in the container. The fluid-dispensing system still further comprises a liquid-metering element that is removably disposed in the conduit. The liquid-metering element has an outlet port that is removably disposed in the plug aperture. The liquid-metering element includes an orificed inlet. The plug aperture is operatively connectable to a vacuum source that is effective for causing liquid concentrate to flow through the liquid-metering element via the conduit, for purposes of withdrawing liquid concentrate from the container at a predetermined rate.

Our fluid-mixing system comprises a container having an opening and adapted to contain a dilutable liquid concentrate, and a nippled plug disposed into the container opening and removably snap-engaged therewith. The plug nipple defines a plug aperture. The plug aperture defines a recess. The fluid-mixing system includes conduit. One end of such conduit is removably carried by the plug nipple. The other end of the conduit is removably disposed through the container opening and is adapted to be immersed into a liquid concentrate that is contained within the container. The fluid-mixing system further comprises a nozzle. The nozzle defines a nozzle inlet adapted for receiving a high-pressure liquid diluent. The nozzle further defines a nozzle mixing chamber and a nozzle outlet. The nozzle mixing chamber defines a vacuum region when high-pressure liquid diluent enters the nozzle inlet and discharges from the nozzle outlet. The nozzle still further defines a liquid-metering passageway having an orificed outlet which is in fluid communication with the nozzle mixing chamber. The liquid-metering passageway includes an inlet port that communicates with the vacuum region via the orificed outlet. The inlet port of the liquid-metering passageway is removably disposed in the plug recess. The fluid-mixing system still further comprises a liquid-metering element, removably disposed in the conduit. The liquid-metering element has an outlet port which is removably disposed in the plug aperture. When disposed thusly the outlet port of the liquid-metering element is in fluid communication with the inlet port of the liquid-metering passageway. The liquid-metering element further includes an orificed inlet that communicates with the vacuum region via the orificed outlet of the liquid-metering passageway, for the purpose of combining liquid diluent and liquid concentrate in predetermined ratioed amounts in the nozzle mixing chamber to thus produce a liquid mixture of desired compositional make-up. Such a liquid mixture is discharged from the nozzle via the nozzle outlet.

The above-discussed aspects of our present invention, as well as numerous other aspects, features and advantages of our invention, are detailedly discussed below.

BRIEF DESCRIPTION OF THE DRAWINGS

Hereinafter, the term "FIG." shall be understood to be an abbreviation, referring to a particular accompanying drawing figure.

Throughout the drawings, like reference numerals refer to like parts.

BEST MODE FOR CARRYING OUT THE INVENTION

While our present invention will now be described with reference to a number of illustrated preferred embodiments, it is to be understood that our present invention is not to be limited to the accompanying illustrated embodiments. 0n the contrary, as those skilled in the pertinent art can well appreciate, our present invention is to be understood to cover all structural as well as all functional alternatives and equivalents, as are defined by the appended claims.

Figure 1:
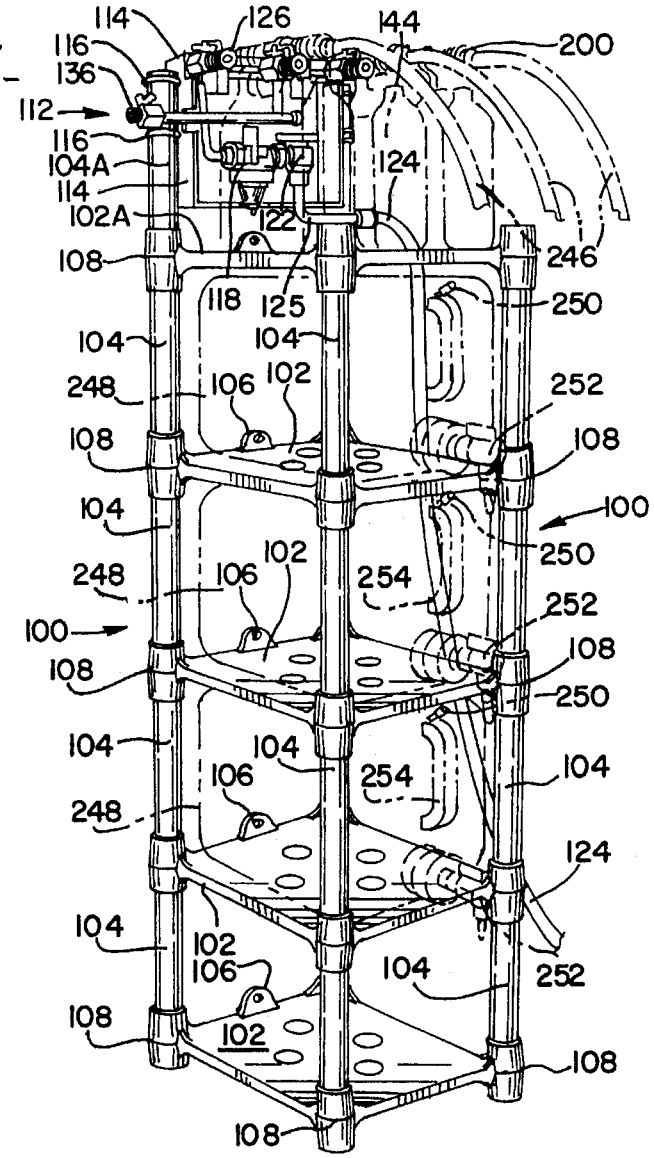
FIG. 1 is a perspective view, showing in so-called "phantom" line certain elements and/or components of our fluid-mixing system, for purposes of clearly showing certain other elements of the fluid-mixing system of our present invention.

Referring now to the drawings and initially to FIGS. 1 and 3, certain elements of one preferred embodiment of our fluid-mixing system will be discussed.

An easily-assembleable stand 100 comprises a plurality of vertically-spaced platforms 102 separated by corner-mounted tubular elements 104. Each such platform or base 102 is preferably rectangular in shape and is preferably manufactured from a relatively-inert yet structurally-strong thermoplastic material. Each such platform or base 102 preferably includes an integral stop 106, which can be located at the midpoint of an edge margin as is illustrated, as well as an integral ring or collar 108, located at each one of the four corner portions of the base or platform 102. Tubular element 104 is removably disposable into ring 108. The inner transverse cross-sectional area of ring or collar 108 is preferably so dimensioned relative to the external transverse cross-sectional area of tube 104, that tube 104 readily is received into ring or collar 108 yet snugly fits therein, for purposes of providing the stand 100 with both vertical and horizontal structural-rigidity and stability. If desired, ring 108 can include an inner, integral annular ledge or stop against which the thus-received end portion of tubular element 104 abuts. (Detail not shown.)

Each such platform or base 102, which thus includes integral stop 106 and integral rings or collars 108, is preferably manufactured of molded one-piece construction.

Figure 2:
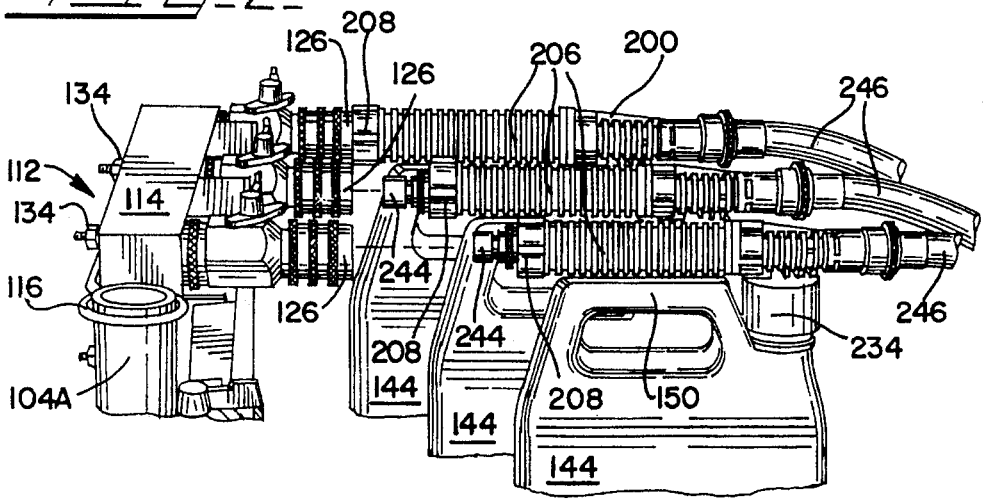
FIG. 2 is a partially-fragmented perspective view, on an enlarged scale relative to FIG. 1, clearly presenting certain elements (of the fluid-mixing system) otherwise shown in phantom line in FIG. 1.
Figure 4:
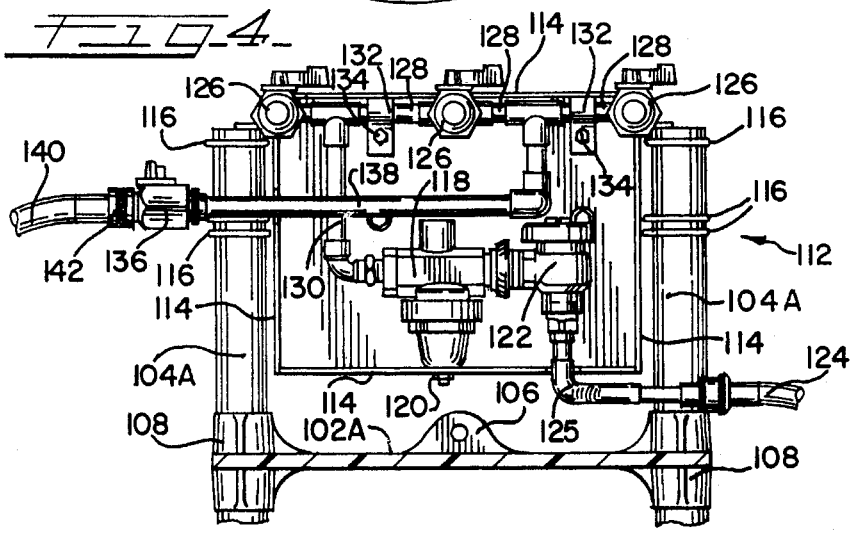
FIG. 4 is a partially-fragmented front elevational view of a manifold shown in FIGS. 1–3, the FIG. 4 view being on an enlarged scale relative to FIGS. 1–3.

Disposed into two adjacent rings 108 of the uppermost or "top" platform 102A are a pair of uppermost tubular members 104A to which are attached a manifold 112. Referring next to FIGS. 2 and 4, certain elements of the manifold 112 will now be discussed.

Housing structure 114 is removably affixed to the top portion of the two uppermost tubular members 104A via brackets 116. Pressure regulator 118 is removably affixed to housing 114 by threaded fastener 120. A backflow check valve 122 is preferably operatively connected to the high-pressure side of pressure regulator 118. Supply line 124, operatively connected to backflow check valve 122 via conduit 125, provides the high-pressure side of pressure regulator 118 with a high pressure liquid diluent such as water. The pressure of the liquid diluent can vary from about 35 pounds per square inch gauge ("psig") to about 125 psig; and the temperature of the liquid diluent may vary from about 40 degrees Fahrenheit to about 120° F.

Valved distribution ports 126, preferably operatively connected in parallel relation via conduit 128 (as shown), are collectively operatively connected to the low-pressure side of pressure regulator 118 via conduit 130. Three such valved distribution ports 126 are shown. Conduit 128 is removably affixed to housing 114 by brackets 132 and threaded fasteners 134. A remote valved distribution port 136, arranged in parallel relation to each of the three ports 126 (as shown), is operatively connected to conduit 128 via elongated conduit member 138.

For reasons that are set forth further hereinbelow, it may be desirable to space remote port 136 from the three ports 126; and a suitable length for conduit member 138 may accordingly be selected. Discharge line 140 can operatively be connected to remote port 136 via quick-disconnect fitting 142.

In operation, high-pressure liquid diluent provided by supply line 124 flows through backflow check valve 122 via conduit 125 and is introduced into the high-pressure side of pressure regulator 118. Pressure regulator 118 reduces the pressure of the high-pressure liquid diluent from, for example, 35–125 psig to 30 psig (give or take 2 psig); and liquid diluent is thus made available either at any one of the three proximate ports 126, or at the remote port 136, at the reduced-pressure value of 30 psig (give or take 2 psig). The internal diameter of the conduits 128, 130 and 138 are so dimensioned as to provide such a reduced-pressure result.

The various above-discussed elements and/or components of our fluid-mixing system are, at present, all commercially available.

Figure 5:
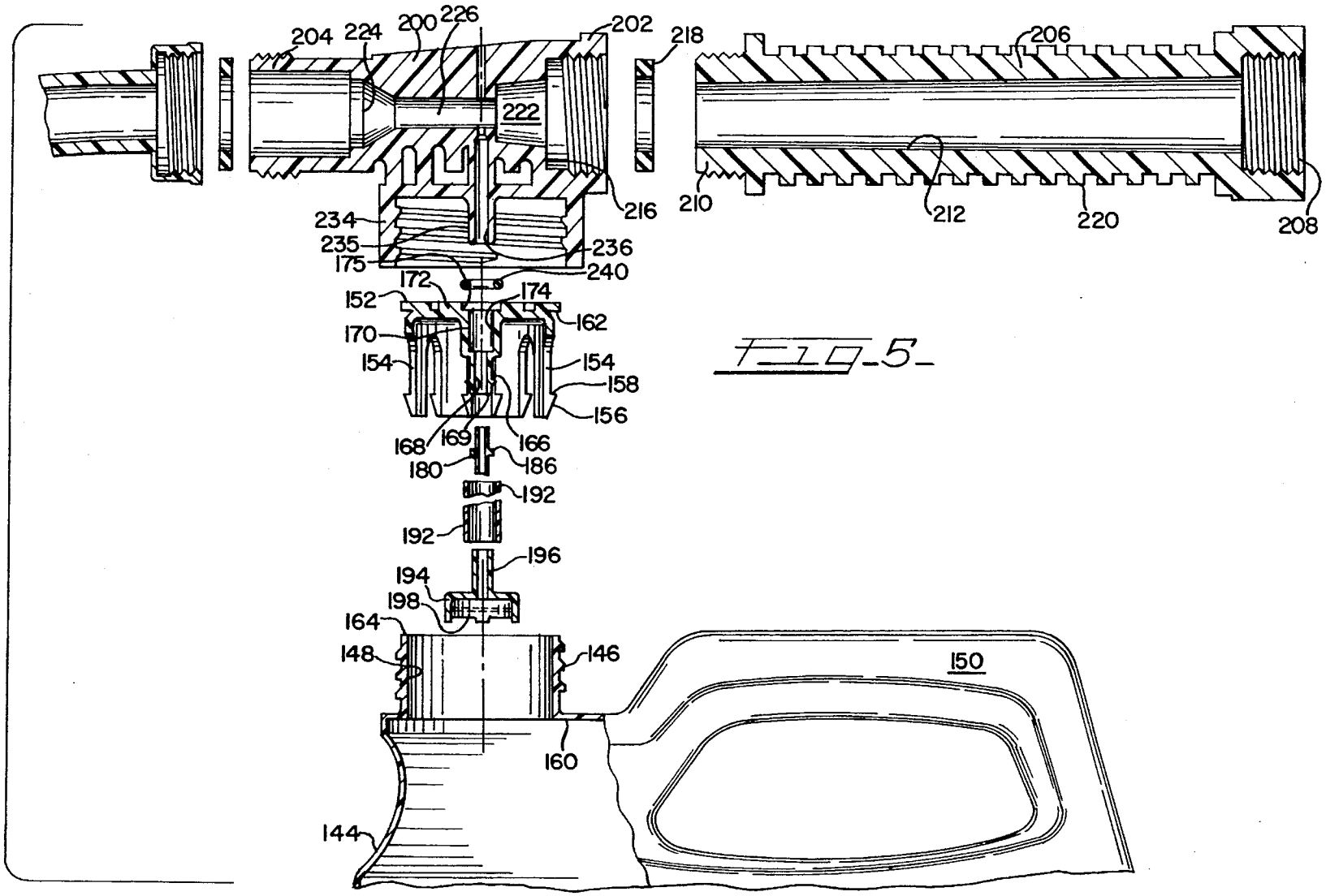
FIG. 5 is a partially-fragmented exploded view, also partially drawn in section, showing certain elements of both the fluid-mixing device as well as the fluid-dispensing system of our present invention.
Figure 10:
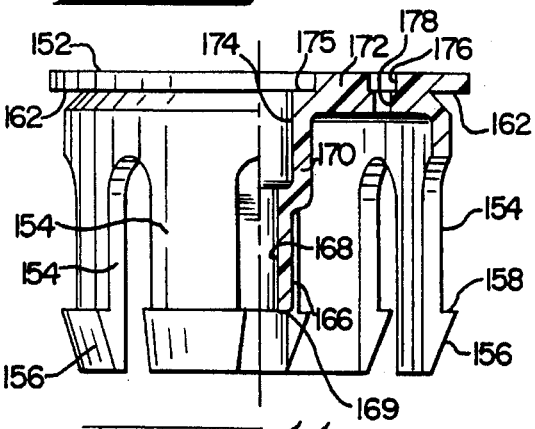
FIG. 10 is a side elevational view, partially in section, taken along the lines 10—10 in FIG. 9.
Figure 14:
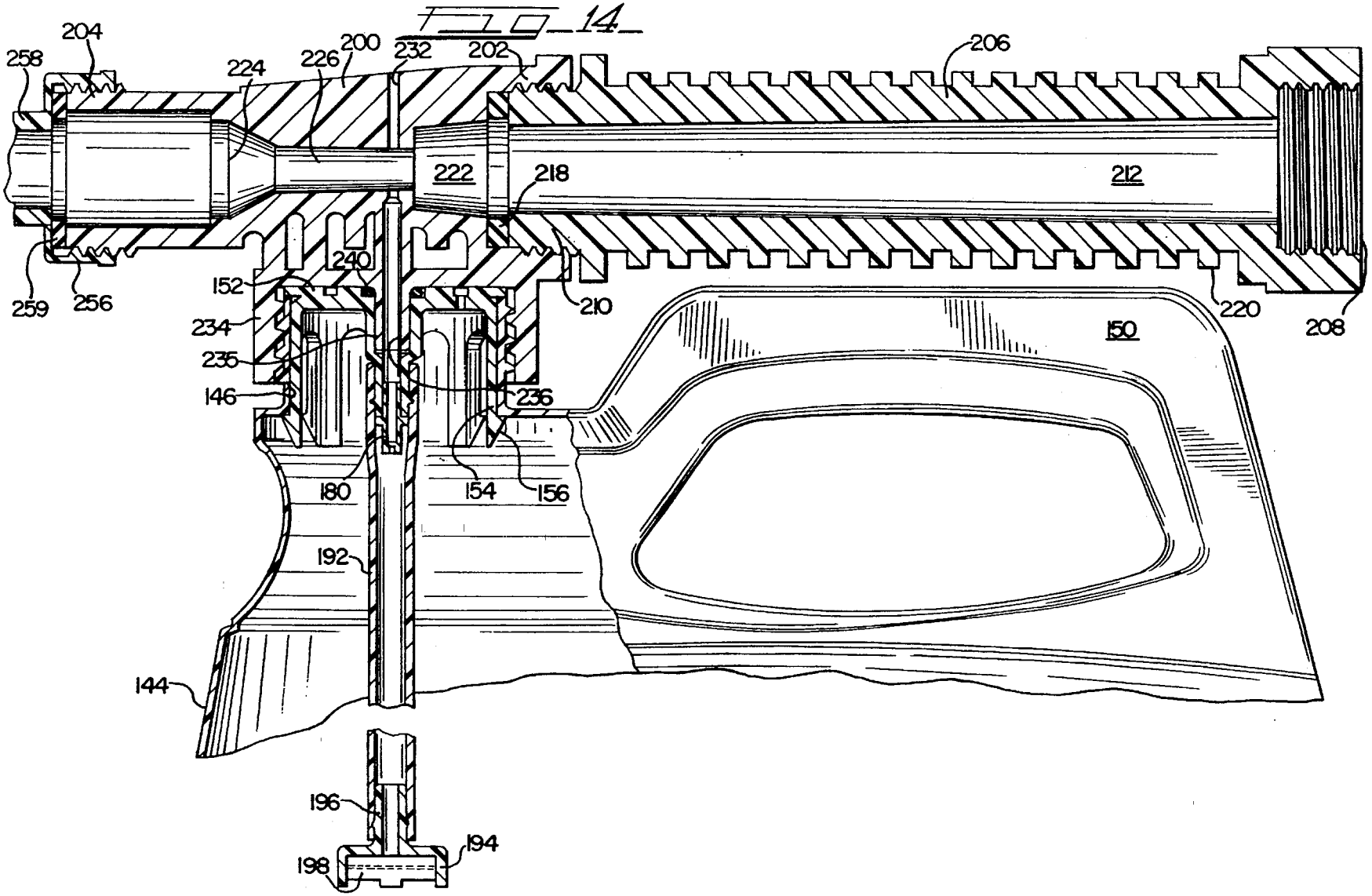
FIG. 14 is an assembled partially-fragmented side elevational view, partially in section, showing certain elements presented in FIG. 5, but on an enlarged scale relative thereto.

Referring now initially to FIGS. 5, 10 and 14, certain other elements and/or components of our fluid-mixing system (which includes both our fluid-dispensing system as well as our fluid-mixing device), will now be discussed.

Our fluid-dispensing system comprises a container 144 having an integral externally-threaded spout 146. Spout 146 thus provides container 144 with an opening 148 which is preferably circular in transverse cross-section. The illustrated container 144 includes an integral carrying handle 150. The container 144 is preferably blow-molded from a relatively-chemically-inert commercially-available thermoplastic material such as polyvinyl chloride ("PVC"), low and/or high density polypropylene, polyethylene, and the like. The container 144 is, moreover, preferably so manufactured as to be able to contain a dilutable liquid concentrate such as various acid-containing commercially-available liquid cleaners, various base-containing commercially-available liquid cleaners, various liquid cleaners for glass, various liquid disinfectant products, and various surface-treatment liquids such as floor strippers, floor polishes, and the like. The container 144 can further include a cap (cap not shown) having internal threads which mesh with the external threads of spout 146, for purposes of preventing spillage of the liquid concentrate from the container 144 during transport of the liquid-filled container.

The fluid-dispensing system of our present invention further comprises a resilient generally-cylindrical apertured cap or plug 152, preferably manufactured from a relatively-chemically-inert flexible plastic material. The generally-cylindrical sidewall of the plug 152 is defined by a plurality of circumferentially-spaced integral fingers 154. Each such finger 154 terminates in an integral frusto-conical end portion 156 and an external radially-disposed ledge 158. The plural fingers 154 are so dimensioned relative to circular opening 148 of container 144 as to be readily insertable into opening 148. The frusto-conical end portion 156 as well as the ledge 158 of each such finger 154 are, moreover, so dimensioned relative to circular opening 148 as to enable plug 152 to be removably snap-engageable with the spout 146 of container 144. In particular, plug 152 is manufactured of a sufficiently resilient plastic material such that forced insertion of the frusto-conical end portions 156 of plug 152 into circular opening 148 of container 144 causes the plural fingers 154 to flex radially inwardly (detail not shown) until the frusto-conical end portions 156 are pushed past an integral flange 160 (FIG. 5), located at the base of the container spout 146.

Plug 152 further includes an integral annular ledge 162 (FIG. 10), disposed radially-outwardly and thus in a direction that is transverse to the orientation of the plural fingers 154. The internal wall surface of spout 146 is cylindrical; and the uppermost portion of spout 146 defines an annular lip 164. In the manufacture of plug 152, the distance between the plug ledges 158 and 162 is so dimensioned relative to the axial distance between the flange 160 and lip 164 of container spout 146 as to cause plug annular ledge 162 of plug 152 to abut annular lip 164 of container spout 146 when all of the finger ledges 158 of the plural fingers 154 of plug 152 are in abutting engagement with flange 160 of container opening 148. (Compare FIGS. 5 and 14.)

Snap-engaged thusly, plug 152 is not easily removable from container opening 148, if it is desirable to maintain the integrity of container 144. However, if the useable amount of dilutable liquid concentrate, initially contained within container 144, has become exhausted, it might become desirable, for example, to cut into the sidewall of container 144 to an extent sufficient to enable removal of the thus snap-engaged plug 152 from spout 146.

Figure 11:
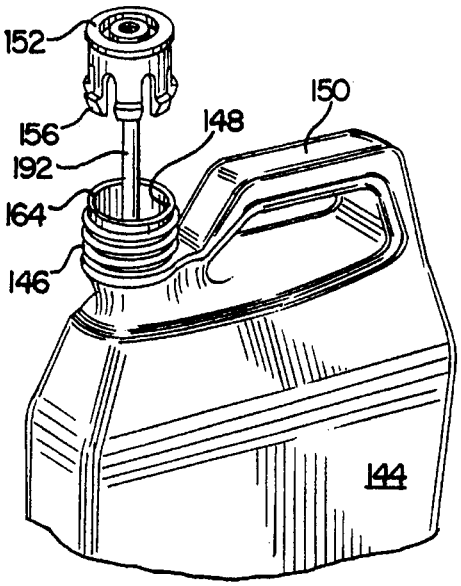
FIG. 11 is a partially-fragmented partially-exploded view, in perspective, showing certain elements of the fluid-dispensing system of our invention, on a reduced scale relative to FIG. 5.
Figure 12:
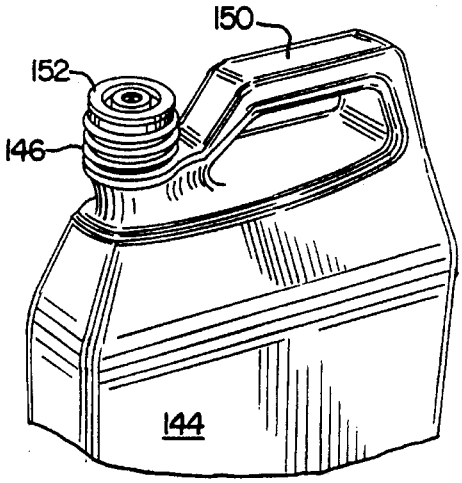
FIG. 12 is an assembled, perspective view of the elements shown in FIG. 11.

Disengaging plug 152 from spout 146 would require collectively flexing the plural frusto-conical finger end portions 156, radially inwardly, by an amount sufficient to disengage the plural finger ledges 158 of plug 152 from the annular flange 160 of the container spout 146, and then withdrawing the plug 152 from the spout 146. (See also, for example, FIGS. 11 and 12.)

Plug 152 further includes an integral nipple 166, spaced radially-inwardly and centrally relative to the plural plug fingers 154. The nipple 166 defines a cylindrical aperture 168, circular in transverse cross section, through plug 152.

Figure 9:
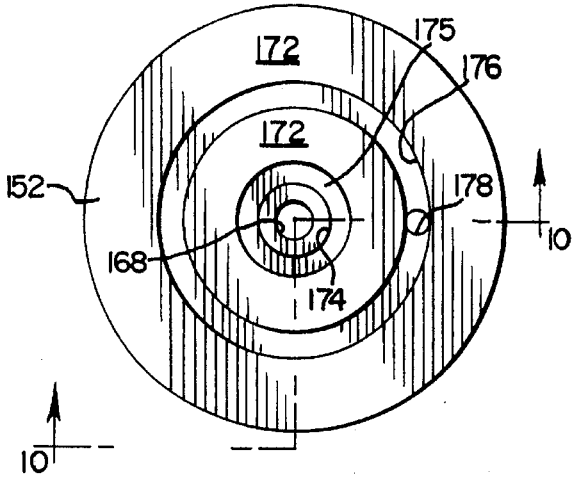
FIG. 9 is a top plan view of an element of our fluid-dispensing system, on an enlarged scale relative to FIG. 5.
Figure 13:
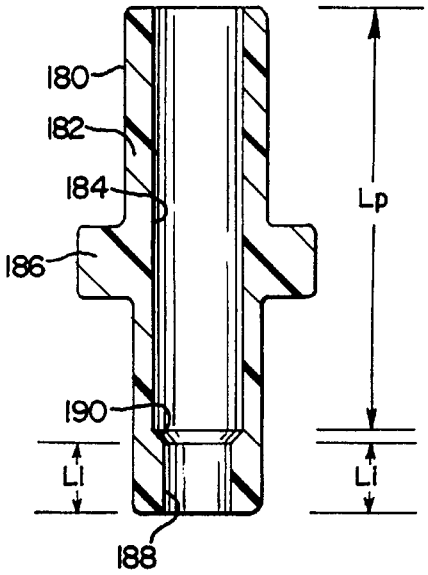
FIG. 13 is a side elevational view, in section, illustrating a preferred embodiment of an orificed liquid-metering element, shown as one element of the exploded view of FIG. 5, the FIG. 13 view being on an enlarged scale relative to FIG. 5.

That end portion of nipple 166 which surrounds aperture 168 defines an annular stop 169. An integral shoulder 170 joins nipple 166 to the top portion 172 of plug 152. The shoulder 170 defines a cylindrical recess 174 that is circular in transverse cross section. The recess 174, in particular, is adjacent to and concentric with aperture 168, with the aperture 168 having the smaller diameter. (See FIGS. 9 and 10.) The top 172 of plug 152 defines an annular channel 175 surrounding recess 174. The top 172 of plug 152 also defines an annular groove 176 which is concentric with the aperture 168 and the recess 174 of plug 152. The top 172 of plug 152 further defines a vent hole 178 through a portion of the groove 176.

The plug, thus-made of one-piece construction, is preferably manufactured of a commercially-available relatively-chemically-inert flexible plastic material such as polyvinyl chloride ("PVC"), high and/or low density polypropylene, polyethylene, and the like.

Referring now to FIGS. 5 and 13–15, certain additional elements and/or components of our fluid-mixing system will be discussed.

An elongated fluid-metering element 180 has a generally cylindrical sidewall 182 which defines an elongated centrally-located fluid passageway 184. The fluid passageway 184 is disposed longitudinally through the metering element 180. The fluid-metering element 180 further includes an annular ledge 186, unitary with the sidewall 182 and disposed radially outwardly therefrom. The external diameter of the sidewall 182 of fluid-metering element 180 is so dimensioned relative to the inner diameter of the aperture 168 of plug 152 as to enable fluid-metering element 180 to be removably insertable into nipple aperture 168 of container plug 152. In particular, fluid-metering element 180 is so dimensioned as to fit readily yet snugly into plug aperture 168, with the annular stop 169 of nipple 166 abuttingly engaging the annular ledge 186 of fluid-metering element 180. (Please compare FIGS. 5 and 15.)

The fluid-metering element 180 still further defines an orificed inlet 188, which preferably extends from plug nipple 166, when the fluid-metering element 180 is thus inserted into the nipple aperture 168.

The fluid passageway 184 and the fluid-metering element orificed inlet 188 are each preferably circular in transverse cross section, with the orificed inlet 188 having a significantly lesser diameter. (See, e.g., FIG. 13.) To achieve presently desired ratioed amounts of concentrate-to-diluent the inner diameter of fluid passageway 184 is nominally 0.070 inches to 0.105 inches, preferably nominally 0.075 inches to 0.100 inches, and the inner diameter of inlet 188 is nominally 0.0060 inches to 0.0760 inches, preferably nominally 0.010 inches to 0.071 inches; and the ratio of the length of the passageway ("Lp") to the length of the inlet ("Li") is about 30:1. Those skilled in the art can well appreciate that this length ratio can be altered for purposes of obtaining any particular desired ratioed amount of liquid concentrate to liquid diluent. Furthermore, certain factors such as, liquid viscosity of the concentrate might require an alteration of length ratio. The inner sidewall surface of fluid-metering element 180 further preferably defines a frusto-conical shoulder 190 (FIG. 13) which smoothly merges the orificed inlet 188 into fluid passageway 184.

Fluid-metering element 180, thus of one-piece construction, is preferably manufactured of a relatively-chemically-inert dimensionally-stable commercially-available plastic material such as polyvinyl chloride ("PVC"), low and/or high density polypropylene, polyethylene, and the like.

Our fluid-dispensing system further comprises tubular conduit or tubing 192. If desired, nipple 166 can include an integral collar 193 (FIG. 15) for securing the conduit 192 to the plug nipple 166. The internal diameter of tubing 192 is so dimensioned relative to the external diameter of the plug nipple 166 such that the plug nipple 166 is snugly yet removably insertable into tubing 192, with the fluid-metering element 180 disposed in the nipple aperture 168. Tubing 192, having a suitable sidewall thickness, is preferably manufactured from a relatively-chemically-inert commercially-available flexible plastic material such as polyvinyl chloride ("PVC"), low and/or high density polypropylene, polyethylene, and the like.

A filter element 194 (FIG. 14) is preferably inserted into the other end of tubing 192. Such a filter element 194 can include an integral cylindrical neck 196 as well as a screen element 198, as shown, if desired.

The external diameter of the filter neck 196, accordingly, is so dimensioned relative to the inner diameter of tubing 192 as to be snugly yet removably insertable into tubing 192. The pores or openings of screen element 198 are in turn themselves so dimensioned as to virtually preclude any non-liquid particles of matter, which might be present in the liquid concentrate and which could conceivably interfere with desired flow of liquid concentrate through orificed inlet 188, from passing to fluid-metering element 180.

Filter element 194 is preferably made of a relatively-chemically-inert commercially-available material such as nylon, various commercially-available stainless steels, polyvinyl chloride ("PVC"), high and/or low density polypropylene, polyethylene, and the like.

In operation, filter element 194 and a portion of tubing 192 are thus intended for immersion into whatever liquid concentrate that is contained in container 144. As will be discussed in detail further hereinbelow, recess 174 (FIG. 5) of plug 152 is operatively connectable to a vacuum source that is effective for causing liquid concentrate to flow through the liquid-metering element 180 via the conduit or tubing 192, for purposes of withdrawing liquid concentrate from the container 144 at a predetermined rate.

Accordingly, our fluid-mixing device, which provides such a vacuum source, will now be discussed. Our fluid-mixing device (FIG. 16) comprises a nozzle 200 having an internally-threaded inlet port 202 and an externally-threaded outlet port 204. An elongated nozzle-inlet extension 206 (FIG. 14), itself has an internally-threaded inlet 208 and an externally-threaded outlet 210. The elongated sidewall of the extension 206 defines a longitudinally-disposed central through bore 212. Bore 212 thus provides fluid communication between extension inlet 208 and extension outlet 210.

Discharge line 140 (FIG. 3) includes an externally-threaded fitting 214. The external threads of fitting 214 are so sized and dimensioned as to intermesh with the internal threads of extension inlet 208, for purposes of providing a fluid-tight seal therebetween.

Figure 16:
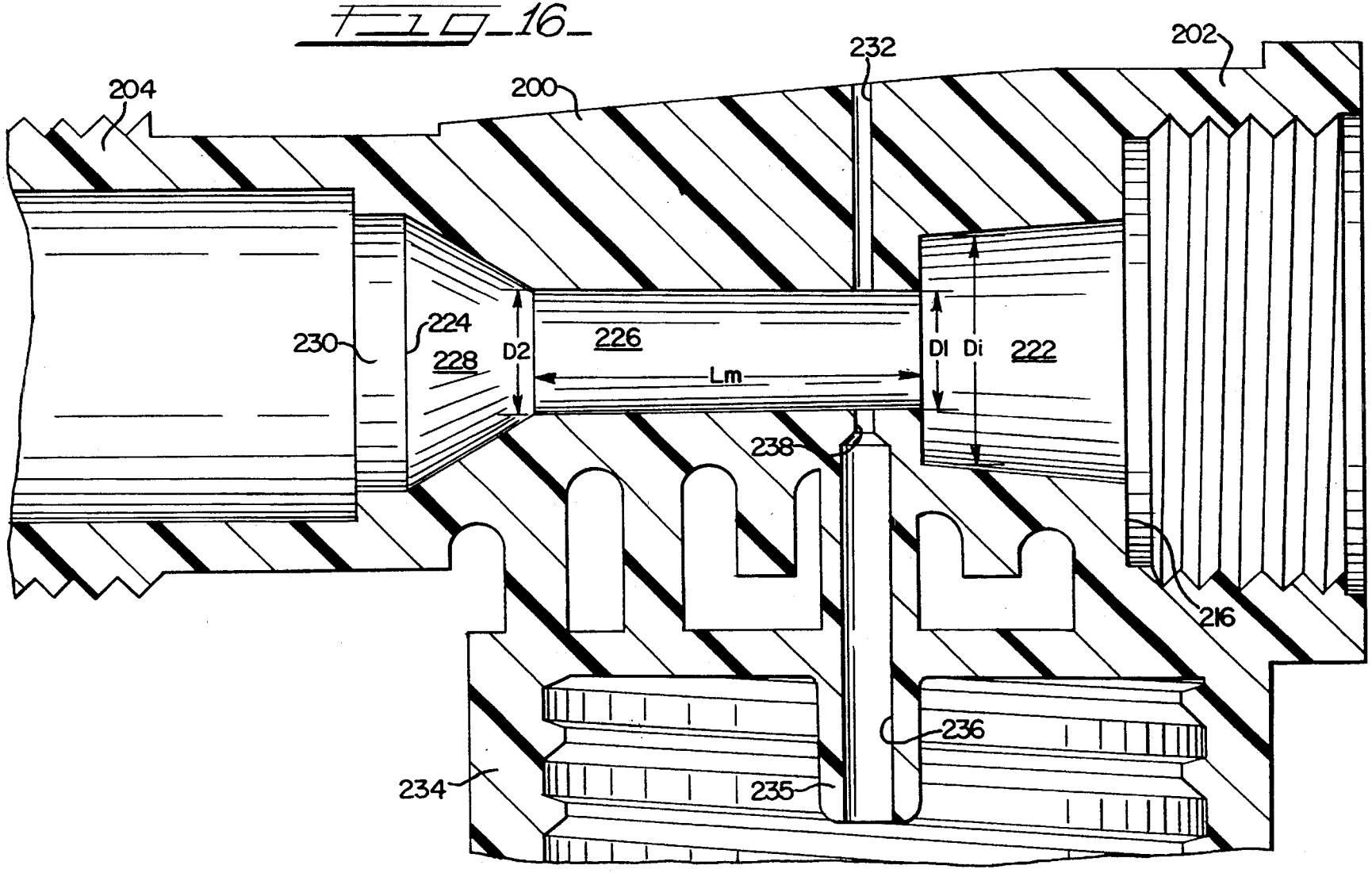
FIG. 16 is a partially-fragmented side elevational view, in section, showing certain other elements of FIG. 14, and on an enlarged scale relative to FIGS. 14 and 15.

The nozzle inlet port 202 defines an annular shoulder 216. (FIG. 16.) The external threads of extension outlet 210 so intermesh with the internal threads of nozzle inlet port 202, when an end portion of extension outlet 210 causes a gasket 218 to abuttingly engage nozzle inlet shoulder 216, as to provide a fluid-tight seal between extension outlet 210 and nozzle inlet 202.

As was mentioned above, the temperature of the liquid diluent, entering the inlet 208 of extension 206 via discharge line 140, may vary from about 40° F. to about 120° F. (Compare FIGS. 3 and 14.)

Accordingly, and for purposes of dissipating heat (as hot liquid diluent thus flows via extension 206 into nozzle inlet 202), the sidewall of hollow extension 206 preferably includes a plurality of longitudinally-spaced circumferential ribs 220, unitary with the sidewall of extension 206. In numerous situations, heat needs to be dissipated when certain fluids are combined. Indeed, one of us (Horvath), in U.S. Pat. No. 3,964,689, discusses a similarly-ribbed extension as well as the need to dissipate heat therefrom in certain situations.

The nozzle 200 further defines a frusto-conical inlet chamber 222 (FIG. 16), a generally frusto-conical outlet chamber 224, and an acutely frusto-conical elongated mixing chamber 226.

One end of the elongated nozzle mixing chamber 226 is immediately adjacent to and in fluid communication with the nozzle inlet chamber 222; and the other end of the mixing chamber 226 is immediately adjacent to and in fluid communication with the nozzle outlet chamber 224. The inlet chamber 222 is immediately adjacent to and in fluid communication with the nozzle inlet port 202. The outlet chamber 224 is immediately adjacent to and in fluid communication with the nozzle outlet port 204.

In operation, high-pressure liquid diluent enters nozzle 200 at the nozzle inlet port 202, and thereafter flows sequentially through the inlet chamber 222, through the mixing chamber 226, and finally through the outlet chamber 224, ultimately exiting the nozzle 200 via its outlet port 204.

The nozzle inlet chamber 222 is characterized as "frusto-conical" because its circular transverse cross-sectional area gradually decreases in the direction-of-flow of the high-pressure liquid diluent. The diameter ("Di") of the nozzle inlet chamber 222 of the illustrated preferred embodiment, where the inlet chamber 222 joins with the nozzle mixing chamber 226, is nominally 0.520 inches. (Please refer to FIG. 16.)

The elongated mixing chamber 226 is characterized as "acutely frusto-conical" because its circular transverse cross-sectional area very gradually increases in the direction-of-flow of the high-pressure liquid diluent. The inlet diameter ("Di") of the mixing chamber 226 of the illustrated preferred embodiment is nominally 0.192 inches; the outlet diameter ("D2") of the mixing chamber 226 of the illustrated preferred embodiment is nominally 0.305 inches; and the length ("Lm") of the mixing chamber 226 is nominally 0.875 inches.

The nozzle outlet chamber 224 is characterized as "generally frusto-conical" because the outlet chamber 224 includes a frusto-conical portion 228 and a cylindrical portion 230. The circular transverse cross-sectional area of the frusto-conical portion 228 gradually increases in the direction-of-flow of the high-pressure liquid diluent. In particular, along the direction-of-flow of the high-pressure liquid diluent, the diameter of the frusto-conical portion gradually increases from D2, the outlet diameter of mixing chamber 226, to the diameter of the cylindrical portion 230.

Those skilled in the art of nozzle technology well know that the above-described nozzle is able to achieve a vacuum condition in the mixing chamber 226 as a result of the so-called "venturi effect" which occurs as the high-pressure liquid diluent flows along the above-discussed direction-of-flow. Those skilled in the art of nozzle technology also well know that the degree or amount of vacuum achieved will in part be due to the flowrate of the high-pressure liquid diluent along the direction-of-flow as well as the pressure differential of the high-pressure liquid diluent between the nozzle inlet port 202 and the nozzle outlet port 204. In the nozzle art, the high-pressure liquid diluent is thus often referred to as the so-called "prime mover" liquid.

In operation, the pressure of the high-pressure liquid diluent is about 30 psig (give or take 2 psig) at the nozzle inlet port 202; and the pressure of the high-pressure liquid diluent is about 25 psig (give or take 2 psig) at the nozzle outlet port 204.

Those skilled in the art of nozzle technology well know that the various above-discussed physical dimensions of the nozzle inlet chamber 222, the nozzle outlet chamber 224, and the nozzle mixing chamber 226 can be varied, if desired, for example, to accommodate a different flowrate of high-pressure liquid diluent, or to achieve a different degree or amount of vacuum. Other factors affecting the degree or amount of vacuum that is achieved, of course, include the pressure of the high-pressure liquid diluent at the nozzle inlet port 202, and the pressure differential of the high-pressure liquid diluent between the inlet port 202 and outlet port 204.

Figure 17:
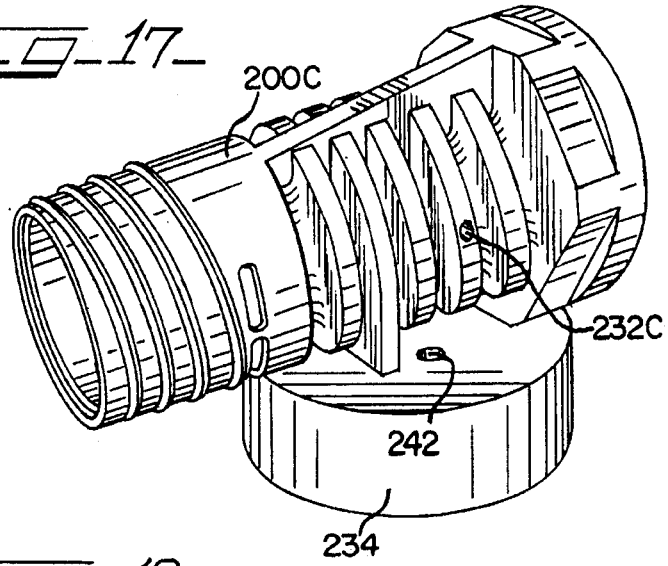
FIG. 17 is a perspective view of still another embodiment of the fluid-mixing device of our present invention, also on an enlarged scale relative to FIG. 5.
Figure 18:
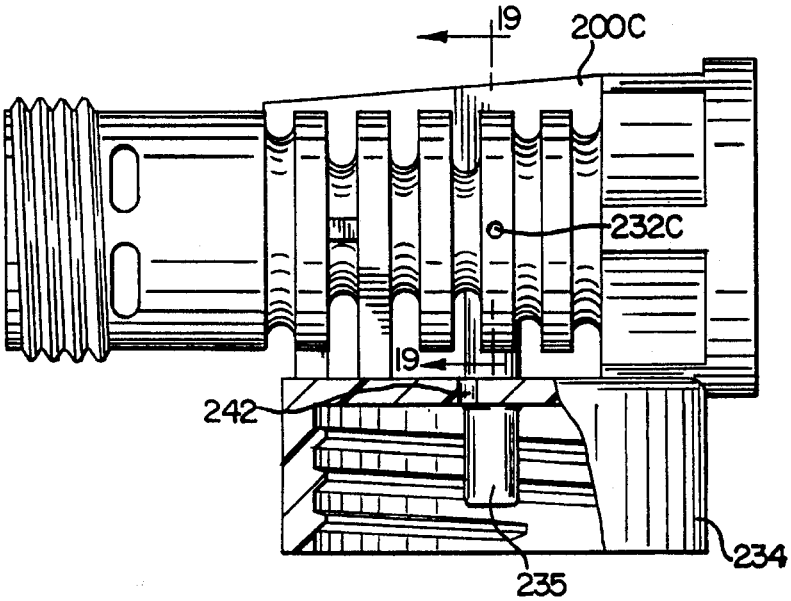
FIG. 18 is a side elevational view, partially in section, on an enlarged scale relative to FIG. 17.
Figure 19:
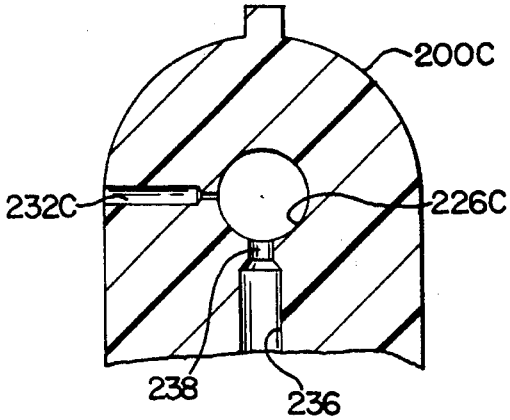
FIG. 19 is a partially-fragmented sectional view, taken along the plane 19—19 in FIG. 18.

One embodiment of the nozzle 200 further defines a vertically-disposed cylindrical vent hole 232 (FIGS. 15 and 16), located adjacent to the inlet chamber 222, for venting the mixing chamber 226 to atmosphere. The diameter of the vent hole 232, preferably 0.020 inches, may of course have a greater or lesser diameter, if desired. Another embodiment of the nozzle 200C defines a horizontally-disposed generally cylindrical vent hole 232C (FIGS. 17–19), for similarly venting mixing chamber 226C (FIG. 19) to atmosphere. The purpose of such a vent hole is to prevent a so-called "siphoning effect", which is discussed in greater detail further hereinbelow.

Figure 15:
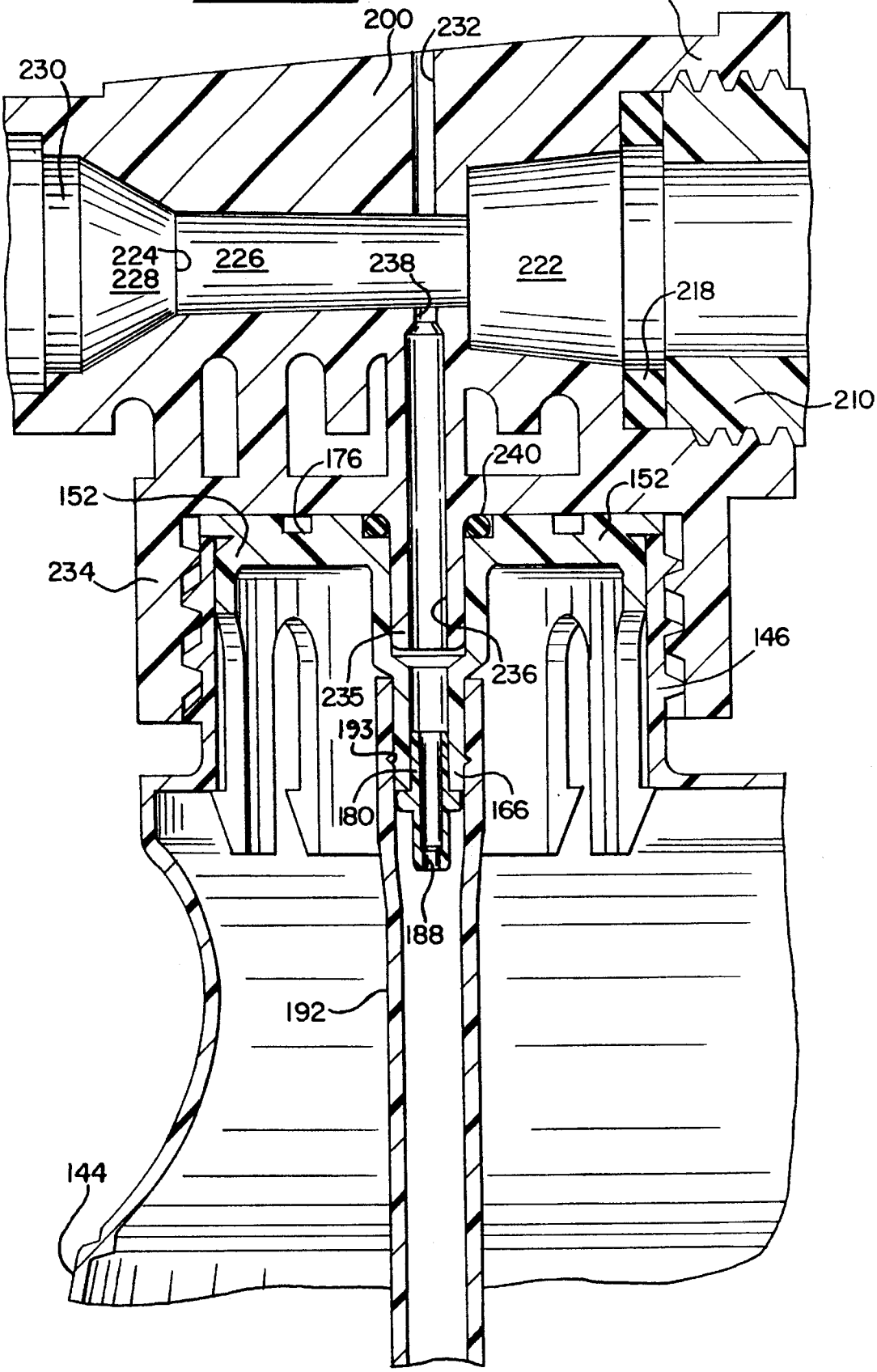
FIG. 15 is a partially-fragmented side elevational view, in section, showing certain elements otherwise shown in FIG. 14, but on an enlarged scale relative thereto.

The nozzle 200 still further defines an integral internally-threaded cap 234 (FIG. 16), disposed transverse to the direction-of-flow of the high-pressure liquid diluent. The cap 234 is unitary with the body of the nozzle 200. The internal threads of the nozzle cap portion 234 are so dimensioned as to mesh with the external threads of the container spout 146. (FIG. 15.)

The nozzle 200 further includes a hollow cylindrical finger 235 (FIG. 16), integral with the cap 234 and the body portion of the nozzle 200, and centrally disposed within the cap 234. In one embodiment of our present invention, the external diameter of the finger 235 is so dimensioned relative to the internal diameter of the plug recess 174 as to enable the nozzle finger 235 to be snugly yet removably disposable into the plug recess 174. (Compare, for example, FIGS. 5 and 15.)

Figure 8:
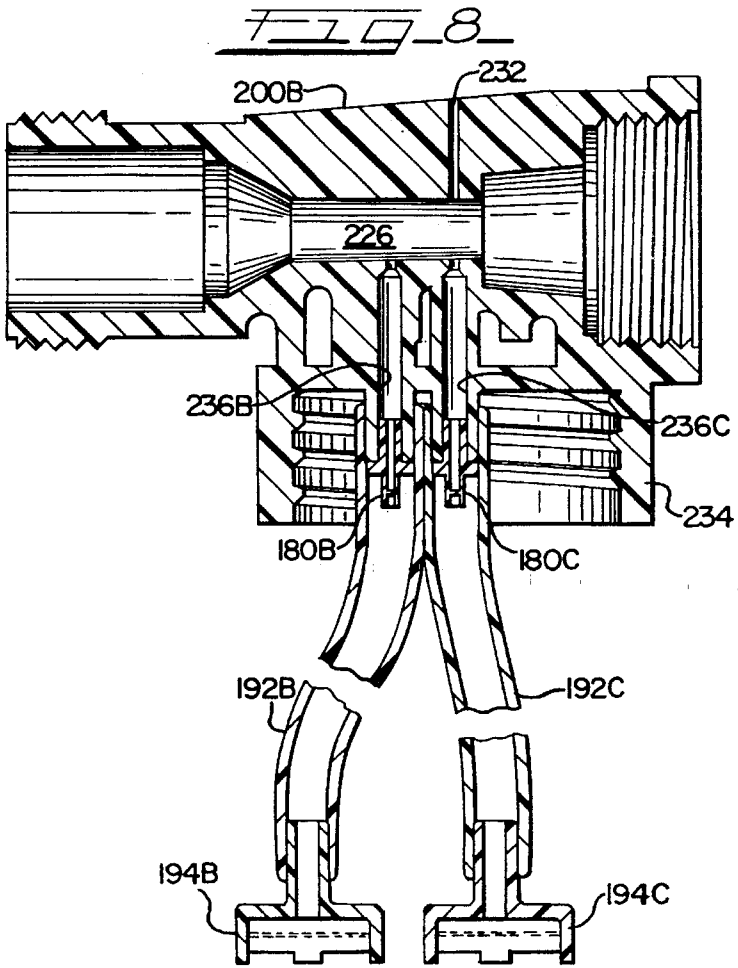
FIG. 8 is a sectional view of still another embodiment of the fluid-mixing device of our present invention.
Figure 7:
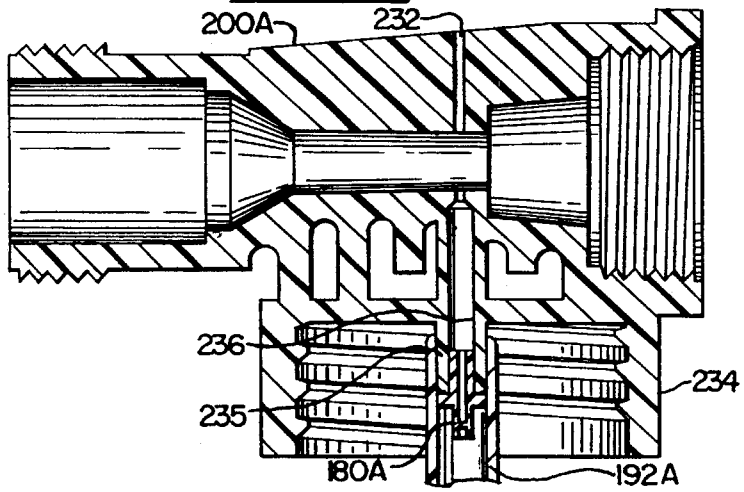
FIG. 7 is a sectional view taken from the plane 7—7 in FIG. 6.

More particularly, finger 235 and a portion of the nozzle body together define an elongated generally-cylindrical fluid passageway 236 (FIG. 16), disposed transverse to the direction-of-flow of the high-pressure liquid diluent. The fluid passageway 236 of the illustrated preferred embodiment, being circular in transverse cross section, has a nominal diameter of 0.120 inches and a nominal length of 0.900 inches. In other embodiments of our present invention, the internal diameter of the fluid passageway 236 is so dimensioned relative to the external diameter of the sidewall 182 (FIG. 13) of the fluid-metering element 180 as to permit the fluid-metering element 180 to be snugly yet removably disposable into the fluid passageway 236. (See, for example, FIGS. 7 and 8.)

The fluid passageway 236 includes a cylindrical orifice 238 (FIG. 16), communicating with the nozzle mixing chamber 226 and located adjacent to the nozzle inlet chamber 222. The diameter of the orifice 238 in the illustrated preferred embodiment is nominally 0.080 inches and the length of the orifice is nominally 0.062 inches.

Nozzle 200, thus of one-piece construction, is preferably manufactured of a relatively-chemically-inert dimensionally-stable commercially-available plastic material such as polyvinyl chloride ("PVC"), high and/or low density polypropylene, polyethylene, and the like.

To achieve operation of the illustrated embodiment of our present invention, the various elements and/or components of our above-described fluid-dispensing system are first partially assembled. (Please refer to FIGS. 5 and 14.) Next, an O-ring 240, suitably dimensioned for purposes of providing a fluid-tight seal between nozzle cap 234 and container spout 146, is disposed into the annular channel 175 (FIG. 10) of the apertured container plug 152. Then, nozzle cap 234 is screwed onto container spout 146. Preferably, the intermeshing threads of cap 234 and spout 146 are so designed as to enable the ribbed extension 206 to overlie the container carrying handle 150, with the cap 234 and spout 146 screwed together in a fluid-tight manner. (Please refer, for example, to FIGS. 2 and 14.)

Figure 6:
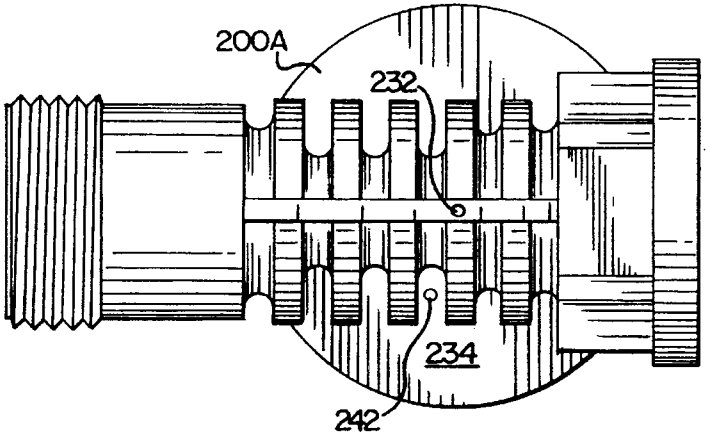
FIG. 6 is a top plan view of yet another embodiment of the fluid-mixing device of our present invention, on an enlarged scale relative to FIG. 5.

The nozzle cap portion 234 further defines a cap vent hole 242 (see, for example, FIGS. 6, 17 and 18), which is so located on the cap 234 as to overlie the annular groove 176 (FIGS. 9 and 10) of plug 152, when plug 152 is snap-engaged into container opening 148 and nozzle cap 234 is screwed onto container spout 146. As was discussed above, the plug annular groove 176 communicates with the internal volume of container 144 via the plug aperture 178. The aperture or vent hole 242 through the cap 234 of the nozzle thus allows air to enter container 144 as liquid concentrate is being withdrawn out of container 144 via conduit 192 as a result of the vacuum effect caused by the movement of the high-pressure liquid diluent through the nozzle, in the manner described above.

With the various above-discussed elements and/or components assembled thusly, flow of the high-pressure liquid diluent into the nozzle inlet port 202 and out of the nozzle outlet port 204 causes the liquid concentrate contained within container 144 to pass, via the conduit or tubing 192, into the mixing chamber 226 where the concentrate and diluent combine to form a liquid mixture. Such a liquid mixture, which consists of precisely-ratioed amounts of concentrate-to-diluent, exits the nozzle 200 at nozzle outlet 204.

When the concentrate serially flows thusly through the orificed fluid-metering element 180 and thereafter through the orificed fluid passageway 236, concentrate-to-diluent ratioes ranging between about 1:15 to about 1:50 can readily be achieved. Indeed, we have observed, while variations of flow of high-pressure liquid diluent occur along the direction-of-flow, that flow of liquid concentrate serially through the orificed fluid-metering element 180 and orificed fluid passageway 236 nevertheless results in desired concentrate-to-diluent ratioes, with no more than about 10 percent volume variation occurring in the concentrate-to-diluent ratio selected initially.

In particular, the following six tables, namely Tables I through VI (presented below), present actual concentrate-to-diluent ratio mixtures (by weight) achieved by our present invention. To demonstrate reproducibility, the reported mixing procedures were performed in duplicate.

In Table I, below, the concentrate used was a commercially-available cleaner (bearing the brand name "HORIZON 400"), having a specific gravity of 1.13 and sold by S. C. Johnson & Son, Inc., of Racine, Wis. The liquid diluent (water) was supplied to the nozzle inlet chamber 222 at 76 degrees Fahrenheit at 30 psig. The nominal diameter of the fluid passageway 184 was 0.070 inches; and the nominal diameter of the orificed inlet 188 was varied, as indicated. The nominal diameter of the elongated fluid passageway 236 was 0.118; the nominal length of the fluid passageway 236 was 0.875; and the nominal diameter of the cylindrical orifice 238 was 0.080.

TABLE I

Concentrate-to-Diluent Ratioes Achieved With "HORIZON 400" Concentrated Cleaner

| Orificed Inlet | Concentrate-to-Diluent Ratioes | |
|---|---|---|
| Nominal Diameter | Run No. 1 | Run No. 2 |
| .010 | 1 to 590 | 1 to 590 |
| .016 | 1 to 227 | 1 to 237 |
| .020 | 1 to 111 | 1 to 112 |
| .031 | 1 to 77 | 1 to 76 |
| .051 | 1 to 55 | 1 to 55 |

In Table II, below, the specifics mentioned immediately above Table I were again followed, except that the concentrate used was a commercially-available cleaner (bearing the brand name "HORIZON 420"), having a specific gravity of 1.05 and sold by S.C. Johnson & Son, Inc., of Racine, Wis.

TABLE II

Concentrate-to-Diluent Ratioes Achieved With "HORIZON 420" Concentrated Cleaner

| Orificed Inlet | Concentrate-to-Diluent Ratioes | |
|---|---|---|
| Nominal Diameter | Run No. 1 | Run No. 2 |
| 0.010 | 1 to 1188 | 1 to 1351 |
| 0.016 | 1 to 274 | — |
| 0.020 | 1 to 221 | 1 to 221 |
| 0.031 | 1 to 127 | 1 to 131 |
| 0.051 | 1 to 92 | 1 to 94 |

In Table III, below, the specifics mentioned immediately above Table I were again followed, except that the concentrate used was a commercially-available cleaner (bearing the brand name "HORIZON 300"), having a specific gravity of 1.19 and sold by S.C. Johnson & Son, Inc., of Racine, Wis.; and the nominal diameter of the fluid passageway 184 was 0.075 inches.

TABLE III

Concentrate-to-Diluent Ratioes Achieved With "HORIZON 300" Concentrated Cleaner

| Orificed Inlet | Concentrate-to-Diluent Ratioes | |
|---|---|---|
| Nominal Diameter | Run No. 1 | Run No. 2 |
| 0.010 | 1 to 456 | 1 to 473 |
| 0.016 | 1 to 145 | 1 to 148 |
| 0.020 | 1 to 94 | 1 to 95 |
| 0.031 | 1 to 65 | 1 to 62 |
| 0.051 | 1 to 49 | 1 to 48 |

In Table IV, below, the specifics mentioned immediately above Table III were again followed, except that the concentrate used was a commercially-available cleaner (bearing the brand name "HORIZON 200"), having a specific gravity of 1.26 and sold by S.C. Johnson & Son, Inc., of Racine, Wis.

TABLE IV

| Concentrate-to-Diluent Ratioes Achieved With "HORIZON 200" Concentrated Cleaner | | |
|---|---|---|
| Orificed Inlet | Concentrate-to-Diluent Ratioes | |
| Nominal Diameter | Run No. 1 | Run No. 2 |
| 0.010 | 1 to 792* | 1 to 963* |
| 0.016 | 1 to 233 | 1 to 250 |
| 0.020 | 1 to 183 | 1 to 185 |
| 0.031 | 1 to 103 | 1 to 104 |

Footnote: *It is believed that the observed amount of variation through this particular orifice was caused by the relatively very high viscosity of this particular concentrated cleaner.

In Table V, below, the specifics mentioned immediately above Table III were again followed, except that the concentrate used was a commercially-available liquid disinfectant (bearing the brand name "VIREX"), having a specific gravity of 1.00 and sold by S.C. Johnson & Son, Inc., of Racine, Wis.

TABLE V

| Concentrate-to-Diluent Ratioes Achieved With "VIREX" Liquid Disinfectant Concentrate | | |
|---|---|---|
| Orificed Inlet | Concentrate-to-Diluent Ratioes | |
| Nominal Diameter | Run No. 1 | Run No. 2 |
| 0.010 | 1 to 458 | 1 to 446 |
| 0.016 | 1 to 174 | 1 to 170 |
| 0.020 | 1 to 103 | 1 to 104 |
| 0.031 | 1 to 46 | 1 to 47 |

In Table VI, below, the specifics mentioned immediately above Table III were again followed, except that the concentrate used was a commercially-available concentrated liquid glass cleaner (bearing the brand name "GLANCE"), having a specific gravity of 1.00 and sold by S.C. Johnson & Son, Inc., of Racine, Wis.

TABLE VI

| Concentrate-to-Diluent Ratioes Achieved With "GLANCE" Concentrated Liquid Glass Cleaner | | |
|---|---|---|
| Orificed Inlet | Concentrate-to-Diluent Ratioes | |
| Nominal Diameter | Run No. 1 | Run No. 2 |
| 0.010 | 1 to 395 | 1 to 370 |
| 0.031 | 1 to 39 | 1 to 40 |
| 0.059 | 1 to 24 | 1 to 24 |
| 0.071 | 1 to 18 | 1 to 18 |

As was briefly suggested above, another embodiment of our nozzle 200A (FIGS. 6 and 7) shows the orificed fluid-metering element 180A being so dimensioned as to be snugly yet removably insertable directly into the fluid passageway 236 of hollow finger 235. Tubing 192A is so dimensioned as to snugly yet removable fit onto the end of finger 235, with the fluid-metering element 180A thus disposed in the fluid passageway 236.

Accordingly, still another embodiment of our nozzle 200B (FIG. 8) discloses a pair of orificed fluid passageways 236B and 236C, each in fluid communication with the fluid-mixing chamber 226. The fluid passageways 236B and 236C, in particular, are arranged in parallel; and each has a fluid-metering element 180B and 180C disposed snugly yet removably into an end portion thereof. Further, tubing 192B and 192C enables liquid concentrate to flow from the container (not shown) into the nozzle mixing chamber 226, for purposes of mixing with the high-pressure liquid diluent to produce a liquid mixture in the manner described above. If desired, a distal end portion of each such tube 192B and 192C can include a respective screened filter element 194B and 194C.

We have found, when the liquid concentrate serially flows through (1) the orificed fluid-metering element 180B and the orificed fluid passageway 236B and simultaneously through (2) the parallel-arranged orificed fluid-metering element 180C and the orificed fluid passageway 236C, that concentrate-to-diluent ratioes ranging between about 1:2 to about 1:1500 can readily be achieved, while high-pressure liquid diluent variations occur along the direction-of-flow, in the manner discussed above, with no more than about 10 percent volume variation occurring in the concentrate-to-diluent ratio that was selected initially. Accordingly, three or more such orificed fluid passageways, arranged in parallel and in fluid communication with the nozzle mixing chamber, may be desirable for a variety of reasons.

In operation, in general, a male quick-disconnect fitting 244 (FIG. 2) is removably screwed into the extension inlet 208 of a thus-assembled nozzle-and-container arrangement. The male quick-disconnect fitting 244 is operatively removably connectable to the female quick-disconnect structure defined by each valved distribution port 126.

Preferably, three such containers 144 are arranged on the uppermost platform or base 102A of the stand 100 (please refer e.g. to FIG. 1), each such container 144 being located adjacent to a respective one of the three valved distribution ports 126.

Operatively connected to the discharge end of each nozzle 200 is conduit 246 (FIG. 2), which supplies a precisely-ratioed mixture of concentrate-to-diluent to a so-called "buddy" jug 248 (FIG. 1) via a jug inlet 250.

The stand 100 (FIG. 1) can support three or more such jugs 248, preferably no more than one jug 248 to a platform 102. Further, each such jug 248 preferably includes a valved outlet 252 and a unitary handle 254.

The illustrated jugs 248 are preferably manufactured of a relatively-chemically-inert plastic material such as polyvinyl chloride ("PVC"), high and/or low density polypropylene, polyethylene, and the like.

Figure 3:
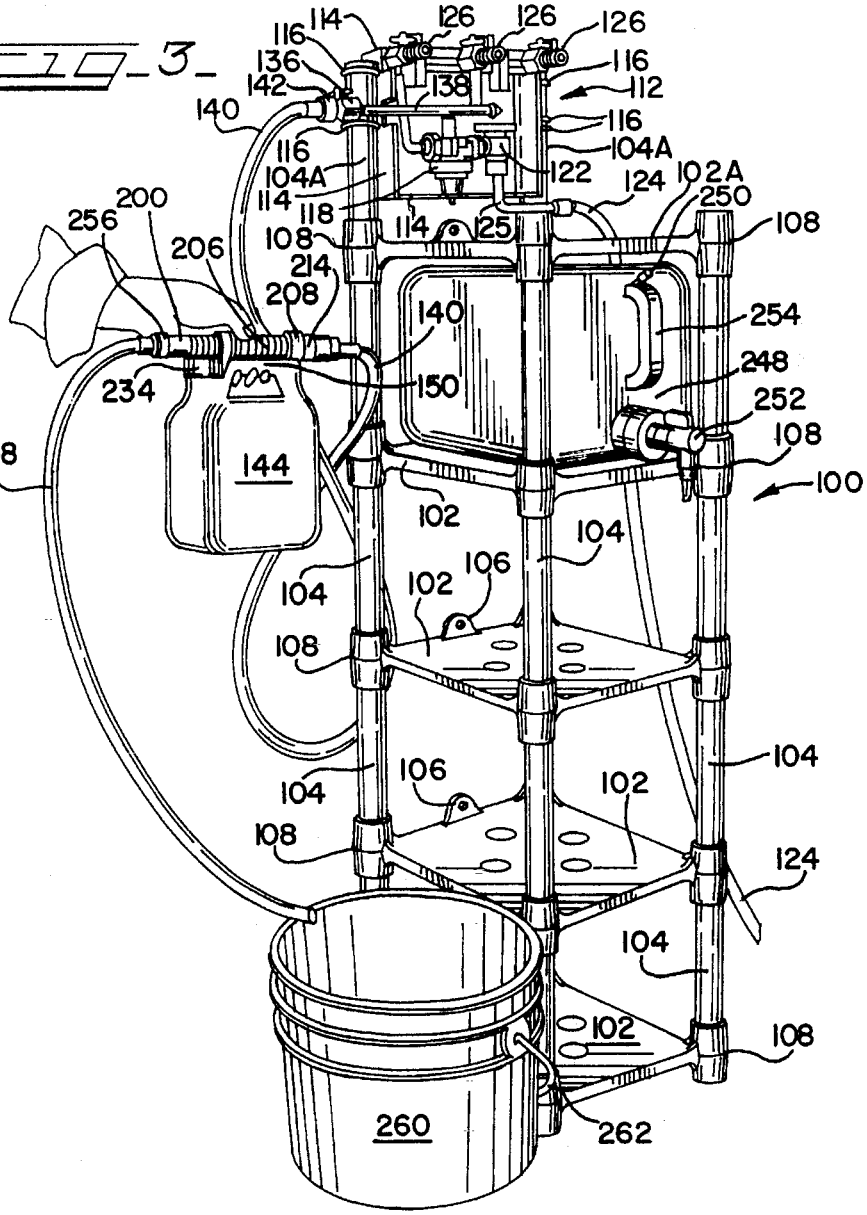
FIG. 3 is yet another perspective view of the fluid-mixing system of our present invention, much like the view of FIG. 1, but illustrating certain other aspects or features of the fluid-mixing system of our invention.

Alternatively, the inlet portion 208 of nozzle extension 206 can operatively be connected to discharge line 140 (as is shown in FIG. 3). In this regard, outlet port 204 (FIG. 14) can be operatively connected via a fitting 256 to conduit 258. (Please compare FIGS. 3 and 14.) A gasket 259, disposed in fitting 256 and abuttingly engaging an end portion of nozzle outlet 204, provides a fluid-tight seal between nozzle outlet port 204 and conduit fitting 256.

Moreover, a length of discharge line 140 is preferably so chosen as to enable a user to carry a thus-assembled nozzle-and-container arrangement as far away from stand 100 as is desired. Thus a bucket 260 (FIG. 3), which may include a handle 262, can easily be filled with any desired amount of the precisely-ratioed concentrate-to-diluent mixture.

Because a vacuum condition can exist in nozzle mixing chamber 226 long after the flow of high-pressure liquid diluent through nozzle 200 has been terminated, the vertically-disposed vent hole 232 (FIGS. 15 and 16) as well as the horizontally-disposed vent hole 232C (FIGS. 17 and 18) have each been provided to avoid a so-called "siphoning effect" which might otherwise occur.

Industrial Applicability

The illustrated system can thus be utilized to provide a wide variety of precisely and accurately mixed ready-to-use liquid products. Such liquid mixture products, more particularly, can readily and reproducibly be prepared within the concentrate-to-diluent ratio ranges of about 1:2 to about 1:1500. A preferred liquid diluent is water. Liquid concentrates include but are not limited to liquid disinfectants, glass cleaners, floor strippers, floor polishes, general purpose surface cleaners, and the like.

The illustrated system is generally of compact design, and can be mounted on wheels so as to be readily portable.

Further, if desired, various fluid-metering elements 180 of desired diameters can be permanently joined to a corresponding number of caps or plugs 152; and the plugs 152 can be color-coded, wherein certain specified colors correspond to particular concentrate-to-diluent mixture ratioes.

Still further, the fluid-dispensing system of our invention can be operated in combination with a pump, in lieu of the fluid-mixing device disclosed herein. In particular, one example of a suitable pump for such a purpose is disclosed in U.S. Pat. No. 4,790,454 to Clark and Horvath (one of us).

A fluid-mixing system comprising a fluid-mixing device and a fluid-dispensing system have been illustrated and described hereinabove. While these various aspects of our present invention have been illustrated and described with reference to certain preferred embodiments, it is to be understood that the present invention is not to be limited to such embodiments. On the contrary, various structural alternatives, changes and other modifications will become apparent to those skilled in the art upon reading the foregoing description. In that regard, all such alternatives, changes and modifications are to be considered as forming a part of our invention insofar as they fall within the spirit and scope of the appended claims.

We claim:

1. A fluid-mixing system comprising:

a plurality of concentrate containers, each such concentrate container having an opening and being adapted to contain a respective one of a plurality of liquid concentrates;

a plurality of plugs, each such plug being disposed into a respective one of the plural concentrate container openings and being snap-engagedly affixed thereto, each such plug defining a plug aperture;

a plurality of first conduit means, one end of each such first conduit means being carried by a respective one of the plural plugs in a manner so as to be in fluid communication with its respective plug aperture, the other end of each such first conduit means being immersed into a liquid concentrate contained within a respective one of the plural concentrate containers;

a plurality of nozzles, each such nozzle defining a nozzle inlet adapted for receiving a pressurized liquid diluent, a nozzle mixing chamber, and a nozzle outlet, whereupon each such nozzle mixing chamber becomes a vacuum region when pressurized liquid diluent enters its nozzle inlet and discharges from its nozzle outlet;

a plurality of first liquid-metering means, each such first liquid-metering means having an outlet port which is in fluid communication with the nozzle mixing chamber of a respective one of the plural nozzles and an inlet port that communicates with the respective nozzle mixing chamber via the outlet port of its first liquid-metering means;

a plurality of second liquid-metering means, each such second liquid-metering means being disposed in a respective one of the plural first conduit means and having an outlet port that is in fluid communication with the inlet port of a respective one of the plural first liquid-metering means, each such second liquid-metering means including an inlet port that communicates with the nozzle mixing chamber of a respective one of the plural nozzles via the outlet port of a respective one of the plural first liquid-metering means, for combining liquid diluent and liquid concentrate in predetermined ratioed amounts in each respective one of the plural nozzle mixing chambers, to thereby produce a plurality of liquid mixtures, each such liquid mixture being discharged from a respective one of the plural nozzles via its nozzle outlet;

a plurality of mixture containers, each such mixture container having a mixture container inlet for receiving a liquid mixture from a respective one of the plural nozzle outlets;

a plurality of second conduit means for transferring each such liquid mixture from a respective one of the plural nozzle outlets into a respective one of the plural mixture containers via the mixture container inlet thereof;

a stand for supporting at least one of the plurality of concentrate containers and the plurality of mixture containers; and a valved manifold carried by the stand for individually providing each one of the plural nozzle inlets with pressurized liquid diluent.

2. The fluid-mixing system as claimed in claim 1 wherein the system further contains a pressure regulator to limit the pressure of the pressurized liquid diluent entering each inlet port of the plural nozzles.

3. The fluid-mixing system as claimed in claim 2 wherein each concentrate container has internal volume and the system, including the container, contains a sufficient number of vent holes to permit venting of the internal volume of each concentrate container to the outside of the container.

4. The fluid-mixing system as claimed in claim 1 wherein each concentrate container has internal volume and the system, including the container, contains a sufficient number of vent holes to permit venting of the internal volume of each concentrate container to the outside of the container.

5. A fluid-mixing system for filling a liquid mixture container with a diluted fluid, comprising:

a plurality of concentrate containers, each such concentrate container having an opening and being adapted to contain a respective one of a plurality of liquid concentrates;

a plurality of plugs, each such plug being disposed into a respective one of the plural concentrate container openings and being snap-engagedly affixed thereto, each such plug defining a plug aperture;

a plurality of first conduit means, one end of each such first conduit means being carried by a respective one of the plural plugs in a manner so as to be in fluid communication with its respective plug aperture, the other end of each such first conduit means being immersed into a liquid concentrate contained within a respective one of the plural concentrate containers;

a plurality of nozzles, each such nozzle defining a nozzle inlet adapted for receiving a pressurized liquid diluent, a nozzle mixing chamber, and a nozzle outlet, whereupon each such nozzle mixing chamber becomes a vacuum region when pressurized liquid diluent enters its nozzle inlet and discharges from its nozzle outlet;

a plurality of first liquid-metering means, each such first liquid-metering means having an outlet port which is in fluid communication with the nozzle mixing chamber of a respective one of the plural nozzles and an inlet port that communicates with the respective nozzle mixing chamber via the outlet port of its first liquid-metering means;

a plurality of second liquid-metering means, each such second liquid-metering means being disposed in a respective one of the plural first conduit means and having an outlet port that is in fluid communication with the inlet port of a respective one of the plural nozzles via the outlet port of a respective one of the plural first liquid-metering means, each such second liquid-metering means including an inlet port that communicates with the nozzle mixing chamber of a respective one of the plural nozzles via the outlet port of a respective one of the plural first liquid-metering means, for combining liquid diluent and liquid concentrate in predetermined ratioed amounts in each respective one of the plural nozzle mixing chambers, to thereby produce a plurality of liquid mixtures for purposes of filling the liquid mixture container with at least one of the plural liquid mixtures, each such liquid mixture being discharged from a respective one of the plural nozzles via its nozzle outlet;

means for supporting the plurality of concentrate containers; and a valved manifold carried by the supporting means for individually providing each one of the plural nozzle inlets with pressurized liquid diluent.

6. The fluid-mixing system as claimed in claim 5, wherein the system further contains a pressure regulator to limit the pressure of the pressurized liquid diluent entering each inlet port of the plural nozzles.

7. The fluid-mixing system as claimed in claim 6 wherein each concentrate container has internal volume and the system, including the container, contains a sufficient number of vent holes to permit venting of the internal volume of each concentrate container to the outside of the container.

8. The fluid-mixing system as claimed in claim 5 wherein each concentrate container has an internal volume and the system, including the container, contains a sufficient number of vent holes to permit venting of the internal volume of each concentrate container to the outside of the container.

9. A fluid-mixing system for filling a liquid mixture container with a diluted fluid, comprising:

a plurality of concentrate containers, each such concentrate container having an opening and being adapted to contain a respective one of a plurality of liquid concentrates;

a plurality of plugs, each such plug being disposed into a respective one of the plural concentrate container openings and being affixed thereto, each such plug defining a plug aperture;

a plurality of first conduit means, one end of each such first conduit means carried by a respective one of the plural plugs in a manner so as to be in fluid communication with its respective plug aperture, the other end of each such first conduit means being immersed into a liquid concentrate contained within a respective one of the plural concentrate containers;

a plurality of nozzles, each such nozzle defining a nozzle inlet adapted for receiving a pressurized liquid diluent, a nozzle mixing chamber, and a nozzle outlet, whereupon each such nozzle mixing chamber becomes a vacuum region when pressurized liquid diluent enters its nozzle inlet and discharges from its nozzle outlet;

a plurality of first liquid-metering means, each such first liquid-metering means having an outlet port which is in fluid communication with the nozzle mixing chamber of a respective one of the plural nozzles and an inlet port that communicates with the respective nozzle mixing chamber via the outlet port of its first liquid-metering means;

a plurality of second liquid-metering means, each such second liquid-metering means being disposed in a respective one of the plural first conduit means and having an outlet port that is in fluid communication with the inlet port of a respective one of the plural first liquid-metering means, each such second liquid-metering means including an inlet port that communicates with the nozzle mixing chamber of a respective one of the plural nozzles via the outlet port of a respective one of the first liquid-metering means, for combining liquid diluent and liquid concentrate in predetermined ratioed amounts in each respective one of the plural nozzle mixing chambers, to thereby produce a plurality of liquid mixtures for purposes of filling the liquid mixture container with at least one of the plural liquid mixtures, each such liquid mixture being discharged from a respective one of the plural nozzles via its nozzle outlet;

means for supporting the plurality of concentrate containers; and a valved manifold carried by the supporting means for individually providing each one of the plural nozzle inlets with pressurized liquid diluent.

10. The fluid-mixing system as claimed in claim 9 wherein each concentrate container has an internal volume and the system, including the container, contains a sufficient number of vent holes to permit venting of the internal volume of each concentrate container to the outside of the container.

11. The fluid-mixing system as claimed in claim 9, wherein the system further contains a pressure regulator to limit the pressure of the pressurized liquid diluent entering each inlet port of the plural nozzles.

12. The fluid mixing system as claimed in claim 11 wherein each concentrate container has an internal volume and the system, including the container, contains a sufficient number of vent holes to permit venting of the internal volume of each concentrate container to the outside of the container.

13. The fluid-mixing system as claimed in claim 12 wherein the predetermined ratioed amounts of liquid concentrate to liquid diluent is in the range of from about 1:221 to about 1:1500.

14. The fluid-mixing system as claimed in claim 9 wherein the predetermined ratioed amounts of liquid concentrate to liquid diluent is in the range of from about 1:2 to about 1:1500.

15. A method of providing a plurality of liquid mixture in predetermined ratioed amounts comprising the steps of I) affixing a plurality of concentrate containers, each containing a dilutable liquid concentrate, to a fluid-mixing system in a fluid-tight manner to permit the liquid concentrate to be drawn into the fluid-mixing system and diluted in a predetermined ratio with a pressurized liquid diluent to form the liquid mixture, and thereafter II) selecting a liquid mixture to be delivered from among a plurality of such mixtures, III) opening a valve distribution port to cause liquid diluent to flow through a nozzle mixing chamber in the system and to create a vacuum effect which draws liquid concentrate into the mixing chamber to produce the desired liquid mixture having a predetermined ratioed amount of liquid concentrate to liquid diluent, and IV) dispensing the liquid mixture;

wherein each concentrate container has an opening and is adapted to contain a respective one of a plurality of liquid concentrates; there being a plug disposed into a respective one of the plural concentrate container openings and being affixed thereto, each such plug defining a plug aperture; and a plurality of first conduit means, one end of each such first conduit means being carried by a respective one of the plural plugs in a manner so as to be in fluid communication with its respective plug aperture, the other end of each such first conduit means being immersed into the liquid concentrate contained within a respective one of the plural concentrate containers; and the fluid-mixing system further comprises a plurality of nozzles, each such nozzle defining a nozzle inlet adapted for receiving the pressurized liquid diluent, a nozzle mixing chamber, and a nozzle outlet, whereupon each such nozzle mixing chamber becomes a vacuum region when the pressurized liquid diluent enters its nozzle inlet and discharges from its nozzle outlet;

a plurality of first liquid-metering means, each such first liquid-metering means having an outlet port which is in fluid communication with the nozzle mixing chamber of a respective one of the plural nozzles and an inlet port that communicates with the respective nozzle mixing chamber via the outlet port of its first liquid-metering means;

a plurality of second liquid-metering means, each such second liquid-metering means being disposed in a respective one of the plural first conduit means and having an outlet port that is in fluid communication with the inlet port of a respective one of the plural first liquid-metering means, each such second liquid-metering means including an inlet port that communicates with the nozzle mixing chamber of a respective one of the plural nozzles via the outlet port of a respective one of the first liquid-metering means, for combining the liquid diluent and liquid concentrate in predetermined ratioed amounts in each respective one of the plural nozzle mixing chambers, to thereby produce a plurality of the liquid mixtures for purposes of dispensing at least one of the plural liquid mixtures, each such liquid mixture being discharged from a respective one of the plural nozzles via its nozzle outlet;

means for supporting the plurality of concentrate containers; and a valved manifold carried by the supporting means for individually providing each one of the plural nozzle inlets with pressurized liquid diluent upon opening a valve distribution port specific to each liquid mixture to be delivered.

16. The method as claimed in claim 15 wherein the liquid mixture is dispensed into a liquid mixture container for subsequent use.

17. The method as claimed in claim 15 wherein the system further contains a pressure regulator to limit the pressure of the pressurized liquid diluent entering each inlet port of the plural nozzles.

18. The method as claimed in claim 17 wherein each concentrate container has an internal volume and the system, including the container, contains a sufficient number of vent holes to permit venting of the internal volume of each concentrate container to the outside of the container.

19. The method as claimed in claim 18 wherein the predetermined ratioed amounts of liquid concentrate to liquid diluent is in the range of from about 1:221 to about 1:1500.

20. The method as claimed in claim 15 wherein each concentrate container has internal volume and the system, including the container, contains a sufficient number of vent holes to permit venting of the internal volume of each concentrate container to the outside of the container.

21. The method as claimed in claim 15 wherein the predetermined ratioed amounts of liquid concentrate to liquid diluent is in the range of from about 1:2 to about 1:1500.

* * * * *